US005205640A

United States Patent [19]

Shin

[11] Patent Number: 5,205,640

[45] Date of Patent: Apr. 27, 1993

[54] MINIATURE FLASHLIGHT

[75] Inventor: Yong-Mik Shin, Seoul, Rep. of Korea

[73] Assignee: Nuri Co., Ltd., Seoul, Rep. of Korea

[21] Appl. No.: 782,983

[22] Filed: Oct. 28, 1991

[30] Foreign Application Priority Data

Apr. 11, 1991 [KR] Rep. of Korea ..... 91-4944

[51] Int. Cl.[5] ..... F21L 7/00; F21L 15/00

[52] U.S. Cl. ..... 362/205; 362/202

[58] Field of Search ..... 362/205, 202, 206, 208, 362/255

[56] References Cited

U.S. PATENT DOCUMENTS

| | | | |
|---|---|---|---|
| 1,342,322 | 6/1920 | Boulanger | 362/205 |
| 2,261,536 | 11/1941 | Wood | 362/205 |
| 2,461,118 | 2/1949 | Lippincott | 362/205 |
| 2,852,632 | 9/1958 | Garland | 362/205 |
| 2,852,633 | 9/1958 | Garland | 362/205 |
| 4,800,469 | 1/1989 | Leon | 362/205 |
| 4,899,265 | 2/1990 | Maglica | 362/205 |
| 5,021,934 | 6/1991 | Hou | 362/205 |

*Primary Examiner*—Richard R. Cole

*Attorney, Agent, or Firm*—Salter, Michaelson & Benson

[57] ABSTRACT

A miniature flashlight comprising a bulb, a casing holding batteries therein, a head rotatably mounted on said casing, a rotary member for connecting electrodes of the battery to terminals of the bulb, and a conductive member. The rotary member is made of non-conductor and provided with connectors made of conductor and also is disposed between the head and the casing in order to rotate in accompanying with rotation of the head with respect to the casing. The conductive member selectively contact with one of the connectors of the rotary member. The conductive member engages with the casing so that the conductive member is rotated in accompanying with the casing with respect to the head. One of the connectors of the rotary member selectively contacts with the conductive member in accordance with rotation of the head with respect to the casing irrespective of the rotational direction, while the other of the connectors always connects the negative terminal of the bulb to the positive electrode of the batteries, thereby turning the bulb on and off in accordance with the rotation of the head with respect to the casing irrespective of rotational direction.

13 Claims, 2 Drawing Sheets

MINIATURE FLASHLIGHT

BACKGROUND OF THE INVENTION

1. Field of The Invention

The present invention relates to flashlights capable of turning a bulb on and off in accordance with turning of the head thereof in right and left direction, and more particularly to a miniature hand-held flashlight having a rotary type device for turning the bulb on and off in accordance with the rotation of the head with respect to the casing irrespective of the rotational direction, thereby accomplishing the convenience in usage and the simplicity of the construction thereof, lengthening the using life thereof by virtue of reduction of trouble by virtue of simplicity of the construction.

2. Description of The Prior Art

Although miniature flashlights have long been known in the art, it is only been recently, with the development of miniature flashlight having a device for turning the bulb "on" and "off".

Conventionally, such a known miniature flashlight comprises a device for turning the bulb on and off and a cylindrical casing for holding the batteries such as disclosed in U.S. Pat. No. 4,658,336 which is referred to this invention as the prior art in conjunction with the drawing, FIG. 5.

As shown in the drawing, the miniature flashlight is provided with a head assembly 2 and a casing 3. The head assembly 2 comprises a head 2' and a head cap 1, screwed with the outer threaded front end of the head 2' at its inner threaded rear end. The head 2' is screwed with the outer threaded front portion of the casing 3 at its inner threaded rear portion. Also, the head assembly 2 carries a reflector insert 6 closely disposed between the head 2' and the head cap 1, said reflector insert 6 carrying a standard flashlight bulb 11 at rear center portion thereof. Abutted to the rear portion of the reflector insert 6 is a movable member 4 which is movable in accordance with the displacement of the head assembly by virtue of the turning actuation thereof. The movable member 4 is connected to a contact member 5 which is movably disposed at the inside of the front portion of the casing 3 and has a first contact terminal 5', adapted to contact with a positive electrode 8 of the battery 7 which is elastically biased by a coiled spring (not shown) provided at the rear portion of the casing 3, and a second contact terminal 10 for being selectively contacted to a negative electrode 9 of the casing 3. Thus, the movable member 4 and the contact member 5, engaging with each other, are elastically supported by the spring in order to be disposed between the reflector insert 6 and the battery 7.

At this state, the head assembly 2 is gradually rotated with respect to the casing 3 in a direction, for example in right direction, in order to be tightened as moving toward the rear portion of the casing 3 as shown at the phantom line A of the drawing. Hence, the reflector insert 6, closely disposed between the head cap 1 and the head 2', moves toward the casing 3 so that the movable member 4 and the contact member 5 engaging with each other move toward the casing 3, resulting in coming off the second contact terminal 10 of the contact member 5 from the negative electrode 9 of the casing 3 so as to turn off the bulb 11.

On the other hand, if the head assembly 2 is released as rotated in reversed direction, for example in left direction, in order to move forwards in accompanying with forward movement of the reflector insert 6, as shown at the phantom line B or the solid line C of the drawing, the movable member 4 and the contact member 5 of the flashlight move forwardly so that the second contact terminal 10 contacts with the negative electrode 9 of the casing 3, resulting in turning on the bulb 11.

Thus, turning the bulb 11 of the above miniature flashlight on and off is accomplished by rotating the head assembly 2 thereof with respect to the casing 3 in forward or reversed direction.

However, the above flashlight has disadvantages in that it needs repeated actuation for rotating the head assembly 2 with respect to the casing 3 in forward or reversed direction for turning the bulb 11 on and off, thereby causing inconvenience in usage therefor. Also, the flashlight is provided with the movable member 4 and the contact member 5, each provided as a movable member, so that it needs auxiliary elements for supporting the members 4 and 5 to move in place, thereby causing the construction of the device for turning on-off the flashlight. Thus, the flashlight has another disadvantages in that there is a difficulty in manufacturing the flashlight and also the using life thereof is relatively short due to frequent trouble resulting from the member of the elements.

Also, the flashlight is often used as if it was a candle such as at a campsite. At this time, the head cap 1 is removed so as to widen the lightening angle thereof, so that the rotation of the head 2' can not allow the reflector insert 6 to move backwardly due to the removal of the head cap 1, tightly supporting the reflector insert 6 at the front portion of the flashlight, thereby causing the bulb 11 turned on not to be turned off. Thus, the flashlight has another disadvantage in that in case of removal of the head cap 1 it needs to engage the head cap 1 with the casing 3 for turning the bulb 11 off.

SUMMARY OF THE INVENTION

It is, therefore, an object of the present invention to provide a miniature flashlight in which the above disadvantages can be overcome and which comprises a rotary type device for turning the bulb on and off, said device capable of turning the bulb on and off by a quarter rotation of the head with respect to the casing irrespective of the rotational direction, thereby accomplishing the convenience in usage.

It is another object of the present invention to provide a miniature flashlight which is provided a device for turning the bulb on and off having the simple construction resulting in prevention of trouble, thereby accomplishing lengthening the using life thereof.

It is still another object of the present invention to provide a miniature flashlight in which the bulb thereof can be turned on and off without engaging a head cap with the head even when the flashlight in removal of the head cap is used as if it was a candle such as at a campsite.

The above mentioned objects of the present invention can be accomplished by providing a miniature flashlight comprising: a bulb; a casing holding batteries therein; a head rotatably mounted on said casing; means for connecting electrodes of said battery to terminals of said bulb, said means made of non-conductor and provided with connectors made of conductor and also disposed between said head and said casing in order to rotate in accompanying with rotation of said head with respect to said casing; and means for selective contact with one of said connectors of said means for connecting said electrodes of the battery to said terminals of the bulb, said means for selective contact engaging with said casing so that said means for selective contact is rotated in accompanying with said casing with respect to said head; wherein said connector of said means for connecting electrodes of said batteries to terminals of said bulb selectively contacts with said means for selective contact in accordance with rotation of said head with respect to said casing irrespective of rotational direction, while the other of said connectors always connects the negative terminal of said bulb to the positive electrode of said batteries, thereby turning said bulb on and off in accordance with the rotation of said head with respect to said casing irrespective of rotational direction.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
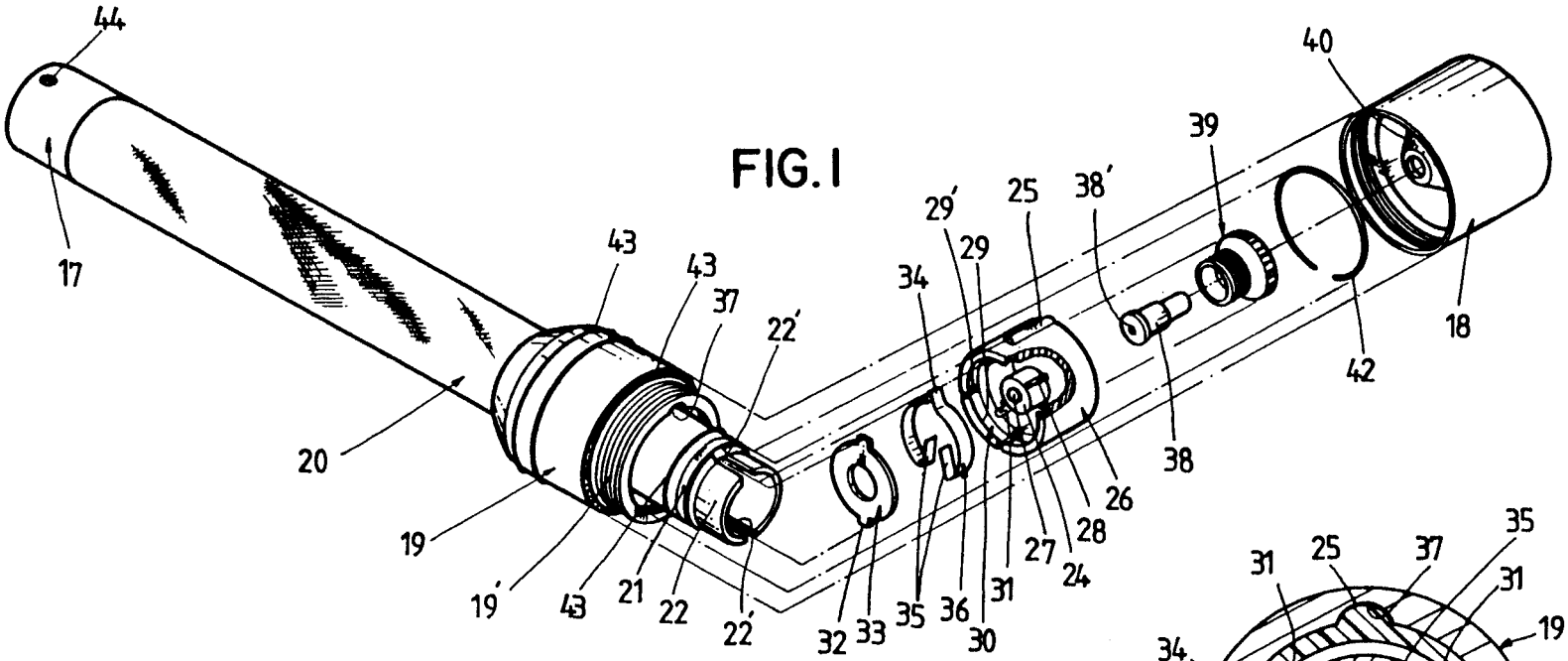
FIG. 1 is an exploded perspective view showing the construction of a miniature flashlight in accordance with the present invention, and especially showing a head retracted with respect to a casing in order to facilitate the appreciation of the construction of the front end of the casing.
Figure 3:
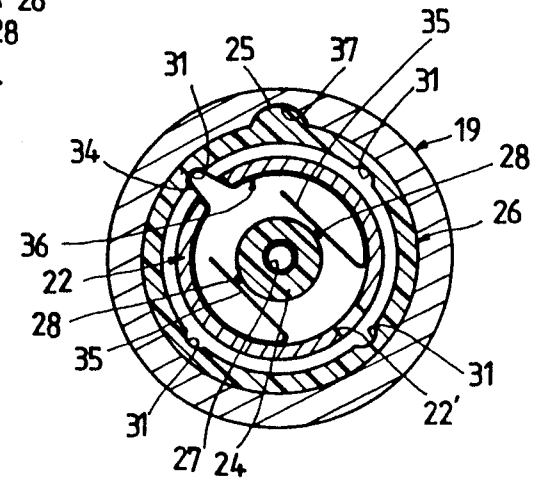
FIG. 3 is a cross sectional view taken along the line A—A of FIG. 2.
Figure 2:
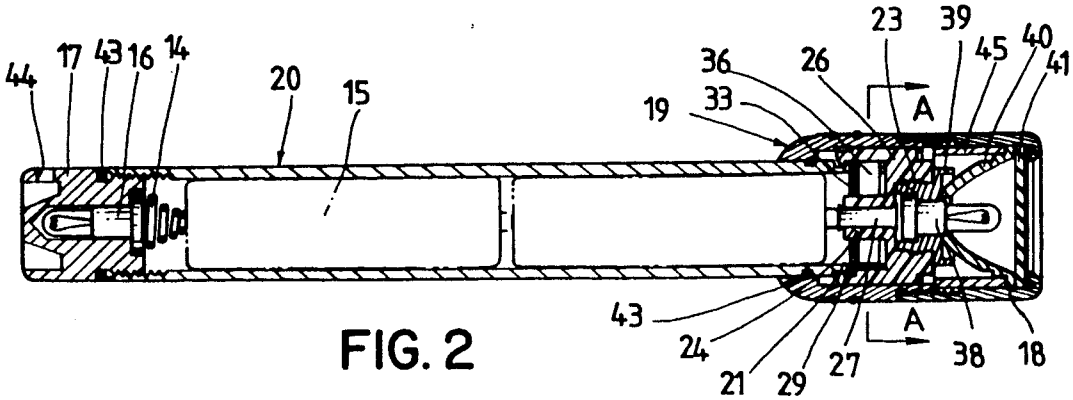
FIG. 2 is a longitudinal section view of the flashlight of FIG. 1, after assembling.

Referring now to FIGS. 1 to 3 which are showing a miniature flashlight in accordance with this invention, the flashlight comprises a cylindrical casing 20 and a head 19, said head 19 rotatably mounted on the casing 20 at the front end of the casing 20. The head 19 is provided with an outer threaded cylindrical end 19' at the front thereof, said end 19' having the reduced outer diameter and including an axial slot 37 backwardly formed on an inner surface thereof from the front end. The casing 20 is provided with a rear cap 17 screwed therewith at the rear end of the casing 20 and holds therein a pair of batteries 15 biased forwardly by a compression coil spring 14 mounted to the front end of the rear cap 17. The rear cap 17 encloses a reserve bulb 16 as shown in FIG. 2.

The casing 20 is provided with an annular fitting groove 21 formed on outer surface near the front end thereof and a reduced diameter end portion 22 integrally extending from the front end provided with the fitting groove 21. The reduced diameter end 22 is provided with a pair of axial slits 22' formed at diametrical opposite positions. Engaging on the reduced diameter end 22 of the casing 20 is a rotary member 26 made of resin. The rotary member 26 has the cup-shaped construction of a cylindrical wall and a bottom, the bottom is provided with an inner threaded cylindrical depression 23 at the outer side thereof but a pipe-shaped projection terminal 24 projecting from the center of the inner side thereof, said projection terminal 24 having a center opening formed from the free end thereof to the inner threaded cylindrical depression 23 so that a side of the member 26 is communicated with the other side thereof. A cylindrical conductive connector 27 penetrates the center opening of the projection terminal 24. The rotary member 26 is also provided with an axial protrusion 25 integrally formed on an outer surface of the cylindrical wall thereof, said protrusion 25 engaging with the axial slot 37 of the head 19. A pair of axial connectors 28 are integrally provided at the diametrical opposite positions of the outer surface of the projection terminal 24.

On the other hand, the rear end of the rotary member 26 has an inner projecting annular portion 29 and a plurality of axial slits 29' so that, in case of inserting the member 26 onto the reduced diameter end 22 of the casing 20, the rear end of the member 26 is elastically outstretched by means of the slits 29' so as to enlarge the diameter of the rear end, thereby making it possible to snap the inner projecting portion 29 on the annular groove 21 of the casing 20. Thus, the rotary member 26 engages with the casing 20 in order to freely rotate with respect to the casing 20 in any rotational direction. Also, the rotary member 26 is provided with four axial slots 31 formed at every 90° of the inner surface of the cylindrical wall thereof as shown in FIG. 3.

Inserted into the reduced diameter end 22 of the casing 20 is a washer 33 having a pair of projections 32 formed at the diametrical opposite positions thereof for engaging with the axial slits 22' of the end 22. The washer 33, disposed in the end 22 by means of the engaging of the projections 32 thereof with the slits 22' of the end 22, supports an elastic conductive member 36 not to move backwardly, which member 36 is inserted into the end 22 and comprises a circular strip comprising a bent radial projection 34 formed at an intermediate point therein and a pair of bent ends 35 formed as bent upwardly at the opposite ends thereof.

As shown in FIG. 1, an O-ring 43 is inserted on the outer surface of the casing 20 near the front end thereof so that the head is rotatably mounted on the casing 20 by means of the O-ring 43. Also, an outer threaded bulb supporter 39 is screwed with the inner threaded cylindrical depression 23 by engaging of the outer threaded portion thereof with the inner threaded portion of the depression 23, said bulb supporter 39 supports a miniature bulb 38 inserted into a center opening provided to the supporter 39. The bulb 38 is provided with a terminal 38' at rear end thereof, which terminal 38' is to always contact with the front end of the cylindrical conductive connector 27 penetrating the center opening of the projection terminal 24 of the rotary member 26. A cylindrical head cap 18 engages with the head 19 by screwing the inner threaded portion thereof with the outer threaded end 19' of head 19. The head cap 18 is provided with a lens 41 and a reflector insert 40 which is supported in place by means of a cylindrical spacer 45 disposed inside the head cap 18 between the front end of the rotary member 26 and the rear surface of the circular periphery of the reflector insert 40.

In the drawings, the reference numerals 42 and 44 denote an elastic ring for preventing the axial movement of the rotary member 26 and a hole for hanging the flashlight as demanded, respectively.

In assembling, the washer 33 is first inserted into the reduced diameter end 22 of the casing 20 as guiding the projections 32 of the washer 33 along the slits 22' of the end 22. The elastic conductive member 36 is then inserted into the end 22 by engaging of the projection 34 of the member 36 with the slit 22' of the end 22 so that the conductive member 36 is supported by the washer 33 at a side thereof. Thereafter, simultaneously with engaging of the protrusion 25 of the rotary member 26 with the axial slot 37 of the outer threaded end 19' of the head 19 the rotary member 26 is inserted onto the reduced diameter end 22 until the inner projecting annular portion 29 of the rotary member 26 snaps on the annular groove 21 of the casing 20. The rotary member has been already provided with the cylindrical connector 27 penetrating the center opening of the projection terminal 24. Thus, the conductive member 36 is supported by the rotary member 26 at the other side thereof. At this time, the projection terminal 24 of the rotary member 26 is disposed between the bent ends 35 of the conductive member 36 and the outer diameter of the projection terminal 24 has so enough size that the ends 35 is elastically outstretched by means of the terminal 24 so that the conductive member 36 is selectively connected to the axial connectors 28 of the rotary member 26 through the bent ends 35. Also, the uppermost end of the projection 34 of the conductive member 36 elastically contacts with the inner surface of the rotary member 26 so that the projection 34 selectively engages with one of the four axial slots 31 of the rotary member 26 in accordance with the rotation of the head 19 with respect to the casing 20 in a direction irrespective of the rotational direction.

Thereafter, the bulb supporter 39 provided with the miniature bulb 38 engages with the inner threaded depression 23 of the rotary member 26 so that the terminal 38' of the bulb 38 contacts with the front end of the cylindrical conductive connector 27 penetrating the center opening of the projection terminal 24 of the rotary member 26, said connector 27 also contacting with the positive electrode of the battery 15. The assembling of the flashlight is accomplished by screwing the head cap 18 having the lens 41 with the outer threaded end 19' of the head 19 under the condition that the cylindrical spacer 45 is disposed between the rotary member 26 and the reflector insert 40.

Thus, the washer 33 and the conductive member 36 move in accompanying with the casing 20, while the rotary member 26 engaging with the bulb 38 moves in accompanying with the head 19 engaging with the head cap 18. Hence, the head 19 and the elements engaging therewith so as to move therewith, such as the rotary member 26 and the like, comprise a head assembly.

The operational effect of the miniature flashlight having the above construction will be described as follows.

Upon tight gripping the casing 20 by a hand of the user at the state of turning the bulb 38 off, The head assembly comprising the head 19 and the head cap 18 is, by means of the other hand of the user, rotated with respect to the casing 20 in a direction irrespective of the rotational direction in order to turning the bulb 38 on as shown in FIG. 3, thereby allowing the rotary member 26 of the head assembly to be also rotated with respect to the casing 20. Thus, the rotary member 26 is rotated with respect to the conductive member 36 supported by the casing not to be rotated so that one of the slots 31 of the side wall of the rotary member 26, so called as a first slot 31, biases the projection 34 of the conductive member 36 engaging therewith to be elastically retracted in order to be released from the engaging state. At this state, the bent ends 35 of the conductive member 36 contact with the cylindrical outer surface of the projection terminal 24 of the rotary member 26 not the axial connectors 28 of the projection terminal 24.

Thereafter, upon continuous rotation of the rotary member 26 in accompanying with rotation the head assembly with respect to the casing 20, the projection 34 of the conductive member 36 elastically contacts with the inner surface of the rotary member 26 and then engages with another slot, a second slot 31 disposed as spaced apart from said first slot 31 at 90° in accordance with the rotation of the rotary member 26. At the state in which the projection 34 engages with the second slot 31 of the rotary member 26, the bent ends 35 contact, as shown in FIG. 3, with the axial connectors 28 integrally provided at the diametrical opposite positions of the side wall of the projection terminal 24. At this state, the circuit for turning the bulb 28 on and off is closed such that the negative terminal 38' of the bulb 38 is connected to the positive electrode of the batteries 15 by way of the cylindrical conductive connector 27 penetrating the center opening of the projection terminal 24 and also the positive terminal of the bulb 38, that is the cylindrical housing of the bulb 38, is connected to the negative electrode by way of the axial connectors 28 of the rotary member 26 and the bent ends 35 of the conductive member 36 contacting with each other, thereby allowing the bulb 38 to be turned on. In the same manner, if the head assembly is, at turning-on state of the flashlight, in quarter rotated with respect to the casing 20 in a direction irrespective of the rotational direction, the bulb 38 is turned off.

On the other hand, the same result can be accomplished by rotation of the casing 20 with respect to the fixed head assembly, on the contrary of the above description.

Thus, the flashlight of this invention accomplishes advantages of the simple construction and the convenience in usage by virtue of the rotary type device for turning the bulb 38 on and off capable of accomplishing its function of turning on-off by quarter rotation of the head assembly with respect to the casing 20 in a direction irrespective of the rotational direction. The simple construction of the flashlight provides another advantage of reduction of the trouble thereof.

Also, the flashlight has another advantage in that the focus of the light of the bulb 38 is easily controlled by releasing or tightening the head cap 18 with respect to the outer threaded end 19' of the head 19, that is, the more the head cap 18 is released with respect to the head 19, the longer the focus of light is.

Figure 4:
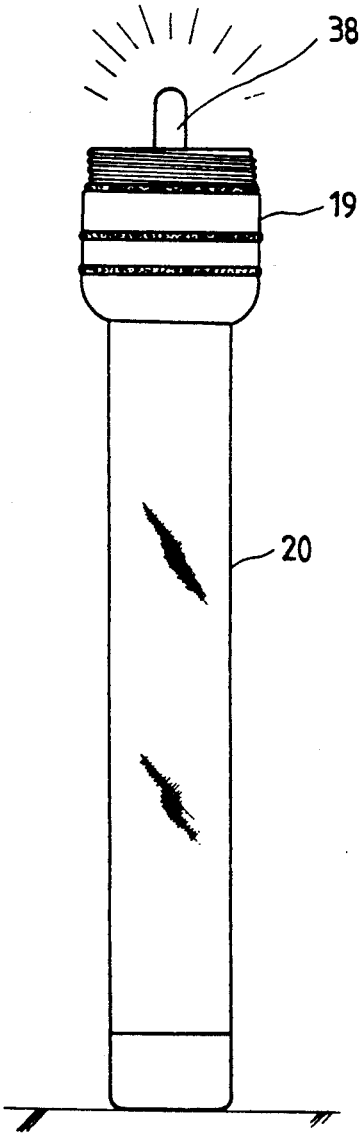
FIG. 4 is a view of the flashlight in accordance with the present invention, showing removal of a head cap therefrom for being used as a candle.
Figure 5:
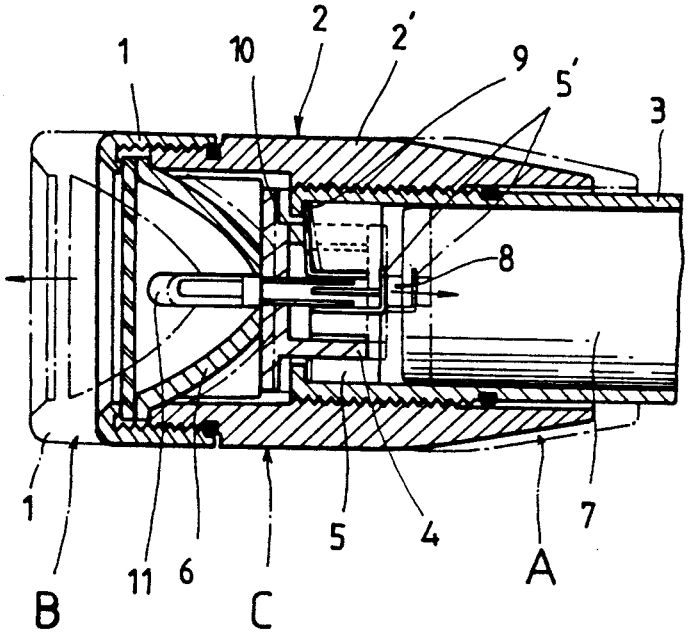
FIG. 5 (PRIOR ART)
FIG. 5 is a sectioned view showing a miniature flashlight in accordance with the prior art.

The flashlight of this invention provides still another advantage in that in case that the flashlight, in removal of the head cap 18 as shown in FIG. 4, is used as if it was a candle such as at a campsite the bulb 38 is turned on and off without engaging the cap 18 with the head 19 because the cap 18 has no concern with the device for turning the bulb 38 on and off.

As described above, The present invention provides a miniature flashlight which provides several advantages in that the simple construction and the convenience in usage are accomplished, resulting in causing the trouble to be prevented and the manufacture therefor to be more easy, and also the bulb is turned on and off in case that the flashlight in removal of the head cap is used as if it was candle such as at a campsite because the cap has no concern with the device for turning the bulb on and off.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A flashlight comprising:

an electrically conductive casing adapted to hold a battery therein, said battery having positive and negative electrodes, said negative electrode electrically communicating with said casing;

a head assembly rotatably mounted on one end of said casing so as to rotate in a clockwise or counterclockwise direction;

an insulating rotatable member received between said casing and said head assembly, said rotatable member being rotatable with said head assembly;

a bulb mounted in said rotatable member, said bulb having positive and negative terminals;

means on said rotatable member for establishing electrical communication between the positive electrode of said battery and the positive terminal of said bulb; and rotary switch means comprising first contact means on said rotatable member and second contact means rotatable with said casing, said first contact means being in electrical communication with the negative terminal of said bulb and said second contact means being in electrical communication with the negative electrode of said battery, said switch means being operated by rotating said head assembly relative to said casing wherein said first contact means contacts said second contact means at one of a plurality of predetermined circumferential locations irrespective of the direction of rotation of said head assembly.

2. A flashlight comprising:

a casing adapted to hold a battery therein, said casing having an outwardly facing groove on the outer surface thereof;

a head assembly having an inwardly facing groove on the inner surface thereof;

an O-ring received in the groove in said outer surface and in the groove in said inner surface for rotatably mounting said head assembly on said casing wherein said head assembly is rotatable in a clockwise or counterclockwise direction;

a bulb mounted within said head assembly; and rotary switch means actuatable for illuminating said bulb, said switch means comprising a first contact means rotatable with said head assembly and second contact means rotatable with said casing, said switch means being operated by rotating said head assembly relative to said casing wherein said first contact means contacts said second contact means at a predetermined circumferential location irrespective of the direction of rotation of said head assembly.

3. A flashlight comprising:

a casing adapted to hold a battery therein;

a head assembly rotatably mounted on said casing so as to rotate in a clockwise or counterclockwise direction, said head assembly having a threaded front end;

a threaded head cap which is received in engagement on said threaded front end, said head cap having a reflector insert therein;

a bulb mounted within said head assembly; and rotary switch means actuatable for illuminating said bulb, said switch means comprising a first contact means rotatable with said head assembly and second contact means rotatable with said casing, said switch means being operated by rotating said head assembly relative to said casing wherein said first contact means contacts said second contact means at a predetermined circumferential location irrespective of the direction of rotation of said head assembly.

4. A flashlight comprising:

a casing adapted to hold a battery therein;

a head assembly rotatably mounted on said casing so as to rotate in a clockwise or counterclockwise direction, said head assembly having an axial slot formed on the inner surface thereof;

a cup-shaped rotary member formed from a non-conductive material, said rotary member comprising a cylindrical wall, a bottom, and an axial protrusion integrally formed on the outer surface of said cylindrical wall, said rotary member being received in said head assembly, said axial protrusion interengaging with the axial slot in said head so that said rotary member is rotatable with said head assembly;

a bulb mounted within said head assembly; and rotary switch means actuatable for illuminating said bulb, said switch means comprising a first contact means rotatable with said head assembly and second contact means rotatable with said casing, said first contact being located on said rotary member, said switch means being operated by rotating said head assembly relative to said casing wherein said first contact means contacts said second contact means at a predetermined circumferential location irrespective of the direction of rotation of said head assembly.

5. In the flashlight of claim 4, said casing including an annular groove formed at the front end thereof, said cylindrical wall having an inwardly protruding lip thereon and further having a plurality of axial slits therein, said lip being received in said annular groove for rotatably mounting said rotary member on said casing.

6. In the flashlight of claim 4, said bottom including an outer side having a threaded cylindrical depression thereon, an inner side having a centrally located cylindrical projection terminal thereon, said projection terminal terminating in a free end, said positive electrode of said battery being disposed adjacent said free end of said projection terminal, said bulb being received in said cylindrical depression, and a conductive member extending through said projection terminal from said free end to said inner threaded depression to establish electrical communication between said positive electrode of said battery and said negative terminal of said bulb.

7. In the flashlight of claim 6, said projection terminal having an outer surface, said first contact means being disposed on the outer surface of said projection terminal and extending through said bottom to electrically communicate with the positive terminal of said bulb.

8. In the flashlight of claim 6, said first contact means comprising a pair of axial terminals positioned at diametrically opposite positions on the outer surface of said cylindrical terminal, said axial terminals extending through said bottom to electrically communicate with the positive terminal of said bulb.

9. In the flashlight of claim 6, said casing having a front end and including a reduced diameter end portion integrally extending from the front end thereof, said reduced diameter end portion having a pair of axial slits formed therein at diametrically opposite positions, said second contact means being received in said reduced diameter end portion.

10. The flashlight of claim 9 further comprising a washer having a pair of radial projections integrally formed at diametrically opposing positions thereon, said axial slits receiving said radial projections, said axial slits further receiving said second contact means.

11. In the flashlight of claim 10, said second contact means comprising a circular strip having an upper end and including a bent radial projection formed at an intermediate point therein and a pair of inwardly bent ends, said cylindrical terminal being disposed between said bent ends, said bent ends being biased inwardly against the surface of said cylindrical terminal in order to selectively contact said axial terminals in accordance with the rotation of said head with respect to said casing.

12. In the flashlight of claim 11, said rotary member including four axial slots formed at 90° intervals around the inside surface of said cylindrical wall, said radial projection of said selective contact means selectively engaging with one of said slots in accordance with the rotation of said head with respect to said casing.

13. The flashlight of claim 6 further comprising a bulb supporter engaging with said bulb and having a threaded portion for engaging with the threaded cylindrical depression of said bottom.

* * * * *